US006681491B2

(12) United States Patent
Currie

(10) Patent No.: US 6,681,491 B2
(45) Date of Patent: Jan. 27, 2004

(54) PAPERBOARD CARTON CUTTING TOOL

(76) Inventor: Alexander H. Currie, 132 Summit Ave., Upper Darby, PA (US) 19082

( * ) Notice: Subject to any disclaimer, the term of this patent is extended or adjusted under 35 U.S.C. 154(b) by 64 days.

(21) Appl. No.: 10/125,715

(22) Filed: Apr. 18, 2002

(65) Prior Publication Data

US 2003/0196327 A1 Oct. 23, 2003

(51) Int. Cl.[7] ..... B67B 7/00; B26B 13/06

(52) U.S. Cl. ..... 30/2; 30/253; 30/258; 30/279.2

(58) Field of Search ..... 30/2, 278, 286, 30/289, 279.2, 258, 241, 123, 253, 279.4, 279.6, 244; 81/415, 416

(56) References Cited

U.S. PATENT DOCUMENTS

| | | | | | |
|---|---|---|---|---|---|
| 447,999 | A | | 3/1891 | Arnold | |
| 476,114 | A | | 5/1892 | Andrews | |
| 950,692 | A | * | 3/1910 | Garrigus | 30/112 |
| 1,009,009 | A | | 11/1911 | Bachand et al. | |
| 1,085,793 | A | * | 2/1914 | Boettger | 30/253 |
| 1,527,220 | A | | 2/1925 | Pyle | |
| 1,849,261 | A | | 3/1932 | Winton | |
| 1,890,234 | A | | 12/1932 | Pickering | |
| 2,516,959 | A | * | 8/1950 | Coull | 30/253 |
| 3,184,843 | A | | 5/1965 | Lurie | |
| 3,362,070 | A | * | 1/1968 | Huggins | 30/253 |
| 3,688,405 | A | | 9/1972 | Dutra, Jr. | |
| 3,803,713 | A | | 4/1974 | Jones et al. | |
| 4,069,584 | A | | 1/1978 | Germain | |
| 4,092,774 | A | * | 6/1978 | Watts | 30/92 |
| 4,158,914 | A | * | 6/1979 | Kurtz | 30/131 |
| 4,291,461 | A | | 9/1981 | Hansen | |
| 4,336,652 | A | | 6/1982 | Robertson | |
| 4,398,314 | A | | 8/1983 | Converse et al. | |
| 4,434,555 | A | | 3/1984 | Stroll | |
| 4,742,616 | A | * | 5/1988 | Lippert | 30/253 |
| 4,835,860 | A | | 6/1989 | Infeld | |
| 5,054,338 | A | | 10/1991 | Weis | |
| 5,388,297 | A | | 2/1995 | Ross | |
| 5,787,589 | A | | 8/1998 | Auderset | |
| 5,987,750 | A | | 11/1999 | Tally | |
| 6,260,462 | B1 | | 7/2001 | Daysh | |

* cited by examiner

*Primary Examiner*—Hwei-Siu Payer
(74) *Attorney, Agent, or Firm*—Dale J. Ream

(57) ABSTRACT

A carton cutting tool for cutting and opening a sealed peaked top of a paperboard carton comprises a first blade attached to a first handle and a second blade attached to a second handle. The first and second blades are pivotally coupled at respective distal ends thereof relative to a user and are movable between open and closed configurations in response to corresponding movements of the first and second handles. At a closed configuration, the second blade overlies the first blade while the second blade is offset approximately 90 degrees from the first blade at the open configuration. The first blade defines a slot extending longitudinally therealong for receiving the peaked top of a carton therein. One longitudinal edge of the slot presents a sharp cutting edge. The second blade includes a slightly convex cutting edge such that a peaked top of a carton that is positioned in the slot is pinched and severed upon a movement of the second blade between open and closed configurations.

15 Claims, 4 Drawing Sheets

PAPERBOARD CARTON CUTTING TOOL

BACKGROUND OF THE INVENTION

This invention relates generally to hand tools for opening cartons and, more particularly, to a tool for cutting a fixed portion of a peaked top from a paperboard carton.

Paperboard cartons of the type having inwardly and upwardly sloping side panels and inwardly folded spout-forming panels forming a peaked top have become very popular for dispensing beverages such as milk and juice. The peaked top is typically glued together to prevent undesired unfolding of the spout-forming panels. In addition, the entire carton may be coated with a sealant such as paraffin to make the carton waterproof. The glued and coated multi-ply peaked top must be torn open or separated to enable a user to drink therefrom. This is often a difficult task and is especially challenging for persons having reduced dexterity or strength in their hands and fingers, such as elderly or disabled persons.

Many devices have been proposed in the art for cutting the peaked top off of a carton so that the spout-forming panels may be easily unfolded. In particular, U.S. Pat. Nos. 3,803,713, 4,291,461, and 4,835,860 disclose such devices. While assumably effective for their intended purposes, existing devices do not adequately provide for stabilizing the peaked top prior to severing it from the carton.

Therefore, it is desirable to have a carton cutting tool which holds a peaked top of a paperboard carton prior to severing it from the carton. Further, it is desirable to have a carton cutting tool which requires the use of two hands for enhanced stability and safety. Finally, it is desirable to have a carton cutting tool which severs only a portion of the peaked top.

SUMMARY OF THE INVENTION

A carton cutting tool according to the present invention includes first and second blades each having proximal and distal ends relative to a user. The cutting tool further includes first and second handles attached to proximal ends of first and second blades, respectively. The distal end of the second blade is pivotally coupled to the distal end of the first blade and therefore is pivotal between open and closed configurations. At a closed configuration, the second blade overlies the first blade while at an open configuration, the second blade is substantially perpendicular to the first blade.

The first blade defines a slot extending longitudinally between its proximal and distal ends. The slot presents a width dimension suitable to receive the multi-ply peaked top of a conventional paperboard carton therethrough. In addition, one of the longitudinal edges of the slot is a sharpened cutting edge. The second blade is slightly convex relative to the second blade and also includes a cutting edge. Therefore, a portion of the peaked top of a carton that is positioned within the slot may be pinched between and severed by the first and second blades as the second blade is moved from an open configuration to a closed configuration. The blades are moved in response to corresponding movements of respective handles.

Therefore, a general object of this invention is to provide a carton cutting tool for severing a portion of a peaked top from a paperboard carton so as to facilitate opening of the carton without tearing or separating the glued side panels of the carton.

Another object of this invention is to provide a carton cutting tool, as aforesaid, having a slot formed in one of a pair of blades for receiving a portion of a peaked top of a carton to be severed by a converging of the blades.

Still another object of this invention is to provide a carton cutting tool, as aforesaid, in which a pair of blades are pivotally coupled at distal ends thereof relative to respective handles such that both hands of a user are required to operate the cutting tool.

Yet another object of this invention is to provide a carton cutting tool, as aforesaid, which only severs a length of the peaked top necessary for the unfolding of a spout forming panel of the carton.

A further object of this invention is to provide a carton cutting tool, as aforesaid, which enables persons with decreased dexterity to safely and efficiently open paperboard cartons.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

A carton cutting tool 10 for cutting a portion of the peaked top of a paperboard carton so as to ease the opening thereof according to a preferred embodiment of the present invention will now be described with reference to FIGS. 1–4 of the attached drawings.

Figure 3:
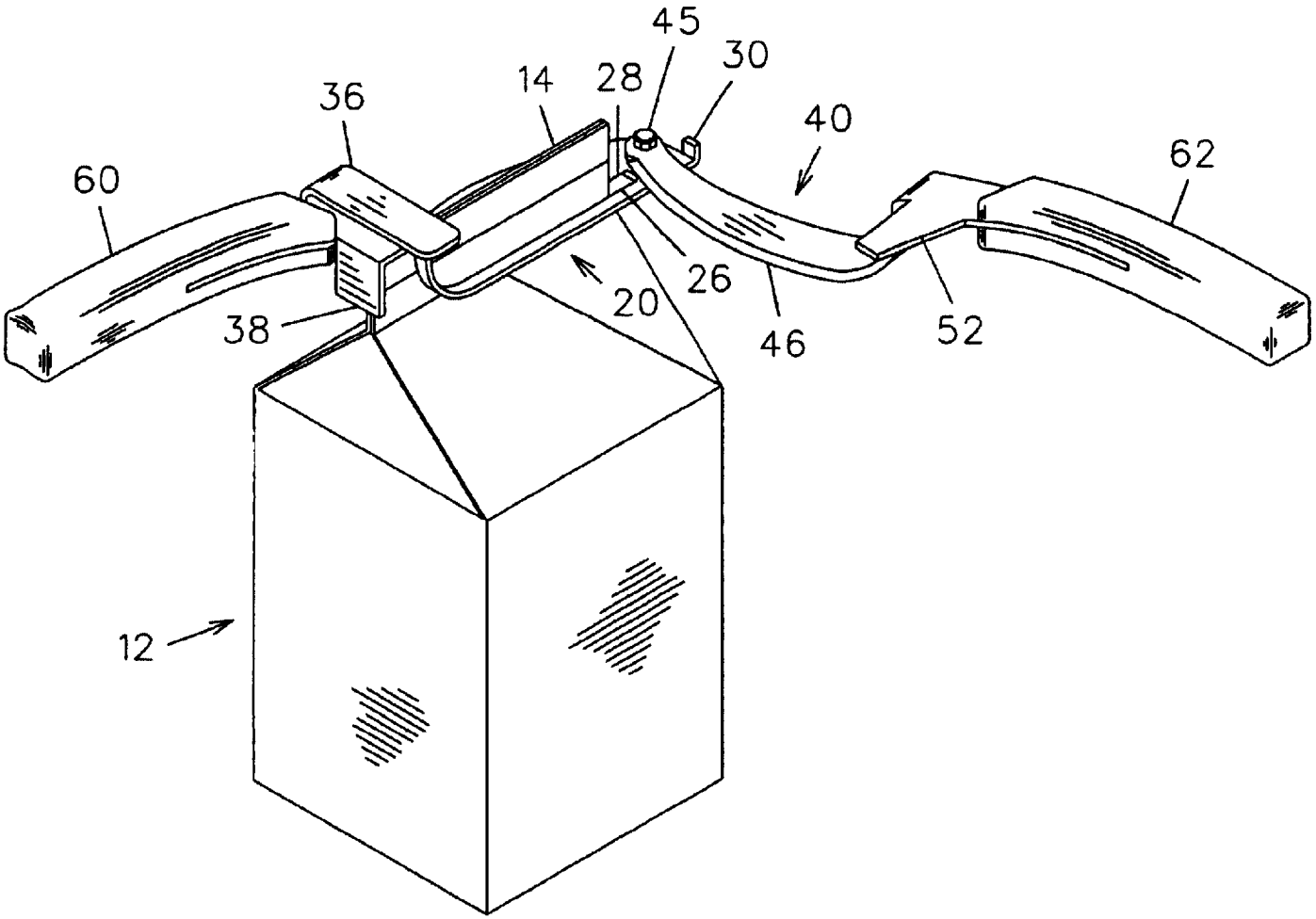
FIG. 3 is a perspective view of the carton cutting tool as in FIG. 1 in an open configuration prior to severing a portion of a peaked top from a carton.

The carton cutting tool 10 includes a first blade 20 having proximal 22 and distal 24 ends relative to a user holding the tool 10. The cutting tool 10 further includes a second blade 40 having proximal 42 and distal 44 ends, the second blade 40 having a length substantially equal to a length of the first blade 20. The cutting tool 10 also includes first 60 and second 62 handles that are curved inwardly toward one another. Proximal ends 22, 42 of the first 20 and second 40 blades are fixedly attached to distal ends of first 60 and second 62 handles. The distal end 44 of the second blade 40 is pivotally connected to the distal end 24 of the first blade 20 with a rivet 45 although the connection may be with a bolt/nut combination, pin, or other suitable fastener. Therefore, the second blade 40 is pivotally movable between a closed configuration closely overlying the first blade 20 (FIG. 1) and an open configuration in which the longitudinal portions of the blades are offset approximately 90 degrees from one another (FIG. 3). The second blade 40 is moved between open and closed configurations in response to a corresponding user movement of the second handle 62. All edges of the blades are blunt except as particularly noted below.

Figure 2:
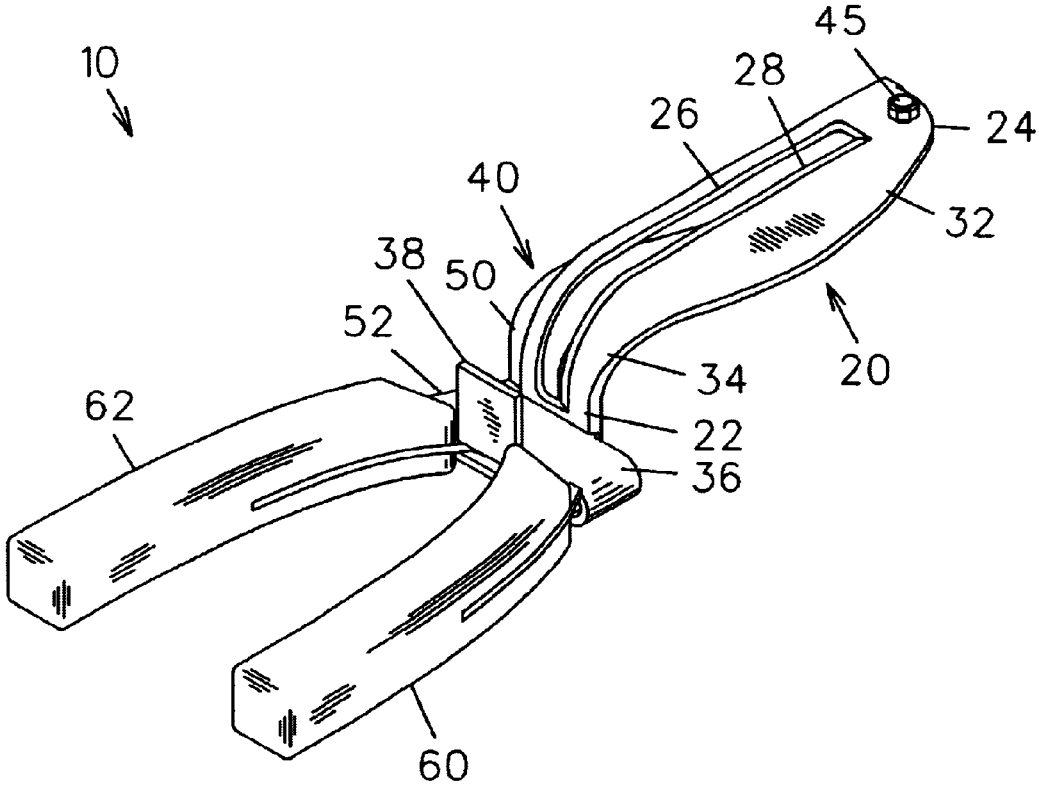
FIG. 2 is a perspective view of the carton cutting tool as in FIG. 1 in an inverted orientation.

The first blade 20 defines a slot 26 extending longitudinally substantially between proximal 22 and distal 24 ends thereof. The slot 26 presents a width dimension suitable to receive a multi-ply peaked top 14 of a paperboard carton 12 therethrough (FIG. 3). The longitudinal edge 28 of the slot 26 most distant from the second blade 40 when considering the second blade 40 in the open configuration presents a sharp cutting edge (FIG. 2). The first blade 20 further includes an upstanding flange 30 integrally extending from the distal end 24 thereof for limiting the pivotal movement of the second blade 40 relative to the first blade 20 (FIG. 3).

Figure 1:
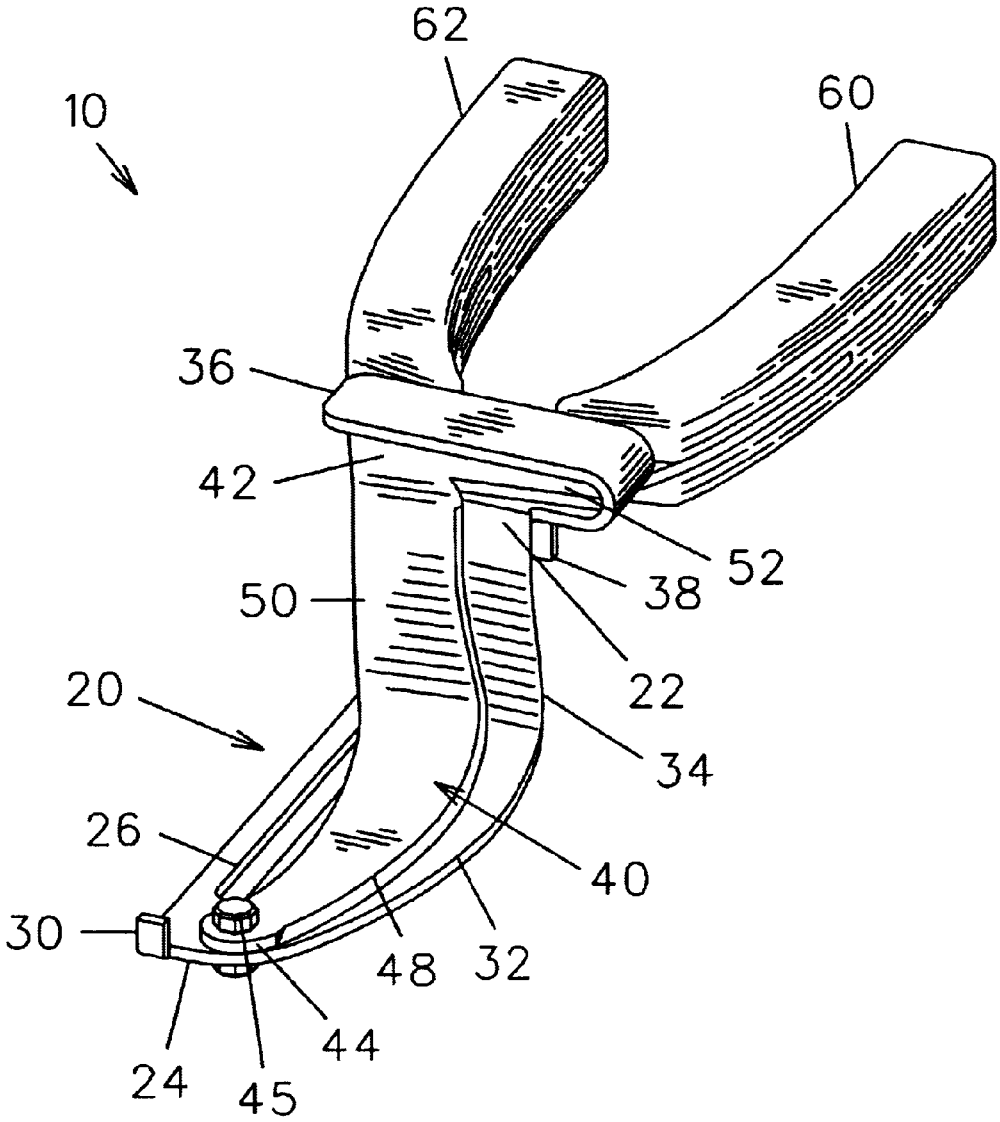
FIG. 1 is a perspective view of a carton cutting tool according to a preferred embodiment of the present invention.
Figure 4:
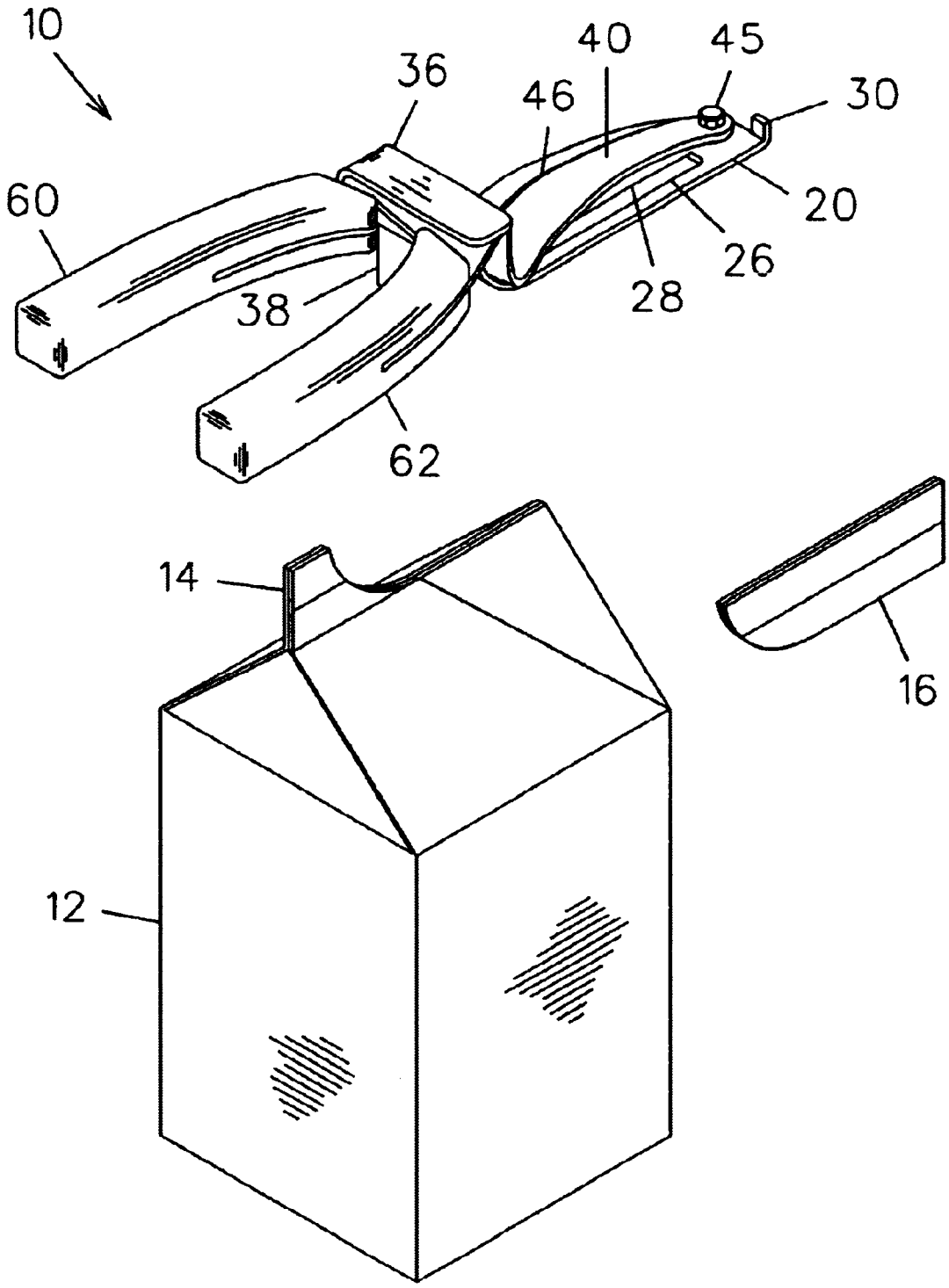
FIG. 4 is a perspective view of the carton cutting tool as in FIG. 1 in a closed configuration and showing a carton portion severed from the peaked top of a carton.

The second blade 40 is slightly convex relative to the first blade 20. The longitudinal edge 46 of the second blade 40 that is first to converge with the first blade 20 when considering a movement of the second blade 40 from an open to a closed configuration presents a sharp cutting edge (FIG. 3). It should be appreciated that the first blade 20 includes a configuration complementary to and slightly wider than that of the second blade 40 such that the cutting edge 46 of the second blade 40 can not be contacted by a user in the closed configuration (FIG. 1). Therefore, a portion 16 of the peaked top 14 of a carton 12 that is positioned within the slot 26 is pinched and severed between the slot cutting edge 28 and second blade cutting edge 46 as the second blade is moved from the open configuration to the closed configuration (FIGS. 3 and 4).

Each blade 20, 40 includes a flat portion 32, 48 extending from a respective distal end 24, 44 toward a proximal end 22, 42. The blades 20, 40 are curved so as to further include upstanding portions 34, 50 integrally extending between respective flat portions 32, 48 and proximal ends 22, 42. This configuration enables the cutting tool 10 to engage and sever a fixed length portion 16 of a peaked top 14 of a carton (FIG. 4). The flat portions 32, 48 of the first 20 and second 40 blades are in a plane parallel to the plane of the handles 60, 62 but are offset by the upstanding portions 34, 50. A thin, flat guide flange 52 is integral to the second blade 40 intermediate the proximal end 42 thereof and the second handle 62. The first blade 20 includes a U-shaped guide member 36 intermediate the proximal end 22 of the first blade 20 and the first handle 60 and disposed so as to receive the guide flange 52 therein in the closed configuration. A stop member 38 depends from the guide member 36 and extends downwardly therefrom for properly positioning the peaked top 14 of a carton 12 in the slot 26 and limiting the peaked top's movement therein (FIG. 3).

In use, a user may grasp the carton cutting tool 10 with both hands, one hand on each handle 60, 62. A movement of the second handle 62 pivots the second blade to an open configuration. The tool 10 may then be secured to a multi-ply peaked top 14 of a paperboard carton 12 by placing the slot 26 over the top 14. The tool 10 may be slidably positioned thereon until the stop member 38 bears against the peaked top 14 (FIG. 3). The second handle 62 may then be again manipulated to pivot the second blade 40 to the closed configuration overlying the first blade 20. This movement results in the cutting edges 28, 46 of the first 20 and second 40 blades pinching and then severing a portion 16 of the top 14 from the carton is (FIG. 4).

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A carton cutting tool for cutting and facilitating the opening of a sealed peaked top of a paperboard carton of the type having at an upper end thereof inwardly and upwardly sloping portions of side panels of the carton and inwardly folded spout-forming panels terminating in said peaked top, said carton cutting tool comprising:

a first blade having a distal end relative to a user, said first blade defining a slot extending longitudinally thereal-ong and adapted to receive the peaked top of a paperboard carton;

a first handle attached to said first blade;

a second blade having a distal end relative to a user pivotally connected to said distal end of said first blade, said second blade movable between a closed configuration overlying said first blade and an open configuration spaced from said first blade;

a second handle attached to said second blade and movable relative to said first handle for moving said second blade between said open and closed configurations; and said second blade having a cutting edge for cutting a portion of a peaked top off of a paperboard carton upon a movement of said first and second blades from an open configuration to a closed configuration when said carton is positioned between said first and second blades.

2. A carton cutting tool as in claim 1 wherein said first handle is fixedly attached to a proximal end of said first blade and said second handle is fixedly attached to a proximal end of said second blade.

3. A carton cutting tool as in claim 1 wherein said first blade includes cutting edge extending along a longitudinal edge of said slot such that the peaked top of a carton positioned within said slot is pinched between said first blade cutting edge and said second blade cutting edge upon a movement of said second blade from said open configuration to said closed configuration.

4. A carton cutting tool as in claim 1 further comprising:

an upstanding flange attached to said distal end of said first blade for limiting movement of said second blade in an opening direction;

a stop means normal to said proximal end of said first blade for positioning a peaked top of a carton in said slot; and a guide member depending from said proximal end of said first blade adapted to guide said second blade between said open and closed configurations.

5. A carton cutting tool as in claim 1 wherein said cutting edge of said second blade is slightly convex to said first blade for enhancing the cutting efficiency between said first and second blades.

6. A carton cutting tool as in claim 1 wherein said first and second blades include generally flat longitudinal portions extending from respective distal ends in a plane parallel to the plane of said first and second handles and having upstanding portions extending between said flat portions and respective proximal ends of said first and second blades, said upstanding portions being substantially perpendicular to respective flat portions.

7. A carton cutting tool as in claim 1 wherein said first and second handles are curved toward each other at said closed configuration.

8. A carton cutting tool as in claim 1 wherein said distal ends of said first and second blades are pivotally connected with a rivet.

9. A carton cutting tool for cutting and facilitating the opening of a sealed peaked top of a paperboard carton of the type having at an upper end thereof inwardly and upwardly sloping portions of side panels of the carton and inwardly folded spout-forming panels terminating in said peaked top, said carton cutting tool comprising:

first and second handle members;

a first blade having proximal and distal ends relative to a user, said proximal end of said first blade being attached to an end of said first handle member;

a second blade having proximal and distal ends relative to a user, said proximal end of said second blade being attached to an end of said second handle member and said distal end of said second blade being pivotally coupled to said distal end of said first blade such that said second blade is pivotally movable between a closed configuration positioned atop said first blade and an open configuration substantially normal to said first blade, said second blade being movable in response to a corresponding movement of said second handle member; and wherein said first blade defines a slot extending longitudinally between said proximal and distal ends of said first blade, said slot adapted to hold said peaked top of said carton therein prior to a movement of said second blade from an open configuration to a closed configuration.

10. A carton cutting tool as in claim 9 wherein said second blade is slightly convex relative to said first blade and includes a cutting edge therealong for enhancing cutting efficiency between the first and second blades.

11. A carton cutting tool as in claim 10 wherein said first blade includes a cutting edge extending along a longitudinal edge of said slot such that the peaked top of a carton positioned within said slot is pinched between said first blade cutting edge and said second blade cutting edge upon a movement of said second blade from said open configuration to said closed configuration.

12. A carton cutting tool as in claim 9 further comprising:

an upstanding flange attached to said distal end of said first blade for limiting movement of said second blade in an opening direction;

a stop means normal to said proximal end of said first blade for positioning a peaked top of a carton in said slot; and a guide member depending from said proximal end of said first blade adapted to guide said second blade between said open and closed configurations.

13. A carton cutting tool as in claim 9 wherein said first and second handle members are curved toward each other at said closed configuration.

14. A carton cutting tool as in claim 9 wherein said first and second blades include generally flat longitudinal portions with upstanding portions adjacent respective proximal ends thereof relative to a user, said upstanding portions being substantially perpendicular to respective flat portions.

15. A carton cutting tool as in claim 9 wherein said second blade is pivotally coupled to said first blade with a bolt and nut combination.

* * * * *